United States Patent [19]

Griffiths

[11] 4,045,992

[45] Sept. 6, 1977

[54] DANCER PULLEY MECHANISM

[75] Inventor: Evan Griffiths, Newington, Conn.

[73] Assignee: Amtel, Inc., Providence, R.I.

[21] Appl. No.: 690,011

[22] Filed: June 4, 1976

[51] Int. Cl.[2] ..... B21C 1/10

[52] U.S. Cl. ..... 72/279; 72/280; 72/288; 72/289

[58] Field of Search ..... 72/278, 279, 280, 282, 72/287, 288, 289, 17; 242/153, 154, 155 R

[56] References Cited

U.S. PATENT DOCUMENTS

| | | | |
|---|---|---|---|
| 3,187,529 | 6/1965 | McIlvried | 72/279 |

FOREIGN PATENT DOCUMENTS

| | | | |
|---|---|---|---|
| 712,892 | 7/1965 | Canada | 72/278 |
| 959,904 | 2/1957 | Germany | 72/279 |
| 915,257 | 1/1963 | United Kingdom | 72/280 |

*Primary Examiner*—Michael J. Kennan
*Attorney, Agent, or Firm*—Prutzman, Hayes, Kalb & Chilton

[57] ABSTRACT

A multiple stage wire drawing system with a plurality of pivotal dancer pulleys, each operable for maintaining wire stock tension between stages and for feeding wire stock downwardly along a generally helical path from an upper guide pulley receiving wire stock from a preceding draw block to a lower coaxial guide pulley aligned for guiding wire stock to a succeeding die block. Each pivotal dancer pulley is mounted via a support rotor on a relatively short pivot arm and for rotation about an axis inclined to its pivot axis, and a toggle type linkage is connected to the dancer pulley support rotor for controlling the angular relationship of the inclined dancer pulley to the coaxial guide pulleys.

9 Claims, 3 Drawing Figures

DANCER PULLEY MECHANISM

BRIEF SUMMARY OF THE INVENTION

The present invention relates generally to dancer pulley mechanisms of the type having a dancer pulley for maintaining and/or adjusting the tension of wire, thread or other line stock, and more particularly to a dancer pulley mechanism having notable utility in maintaining and/or adjusting the tension of wire stock in wire drawing systems, particularly multiple stage wire drawing systems of the type used in drawing relatively large diameter wire stock.

It is a primary aim of the present invention to provide in a multiple stage wire drawing system, a new and improved dancer pulley mechanism of the type having a dancer pulley mounted for rotation about an axis inclined to an axis of pivotal adjustment and which permits its radius or pivotal adjustment to be relatively short without limiting its functional utility through a relatively large adjustment angle.

It is another aim of the present invention to provide in a multiple stage wire drawing system, a new and improved dancer pulley mechanism which permits the usual wire draw blocks and the wire guide pulleys provided for guiding wire stock to and from each dancer pulley to be mounted in operational alignment with their axes parallel and vertical and whereby the multiple stage wire drawing system can be constructed at a substantially lower initial cost and can be more easily threaded and operated.

It is another aim of the present invention to provide in a multiple stage wire drawing system, a new and improved dancer pulley mechanism which provides greater flexibility in the design of the conventionally required wire guide system provided for guiding wire stock to and/or from the dancer pulley.

It is a further aim of the present invention to provide a new and improved dancer pulley mechanism having notable utility in the tensioning of relatively rigid line stock and feeding the rigid line stock between a pair of axially spaced coaxial guide pulleys or other non-aligned components of an associated system.

It is another aim of the present invention to provide a new and improved dancer pulley mechanism of the type having an inclined dancer pulley mounted for pivotal movement along a predetermined arc and which provides for controlling the angular relationship of the inclined dancer pulley to the feed paths of the line stock to and from the dancer pulley.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENT

Figure 1:
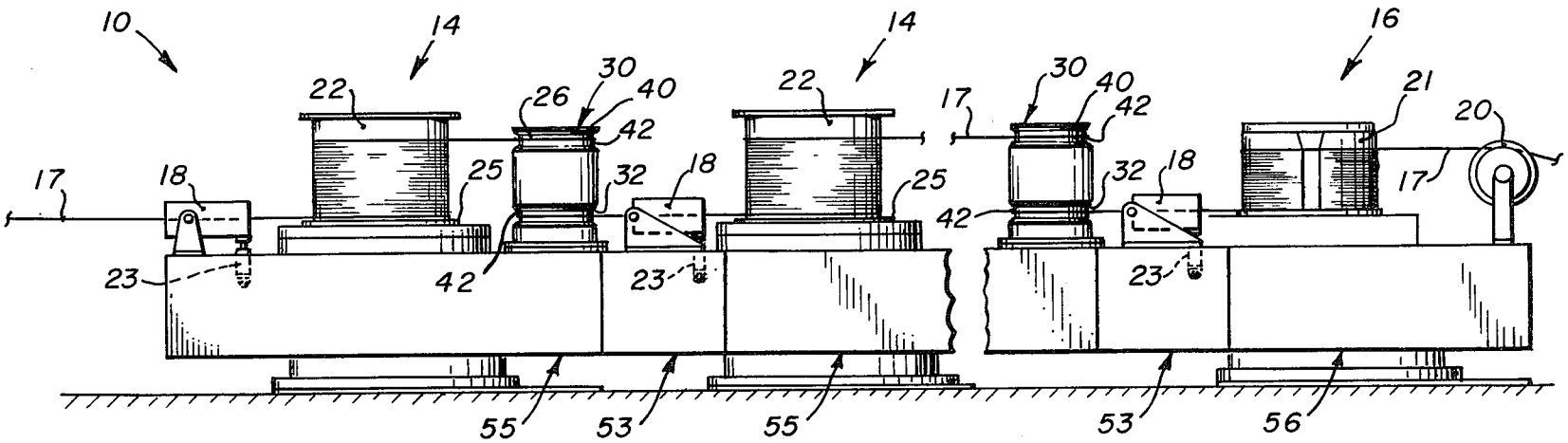
FIG. 1 is a partial, generally diagrammatic front elevation view, partly broken away, of a multiple stage wire drawing system incorporating an embodiment of a dancer pulley mechanism of the present invention.
Figure 2:
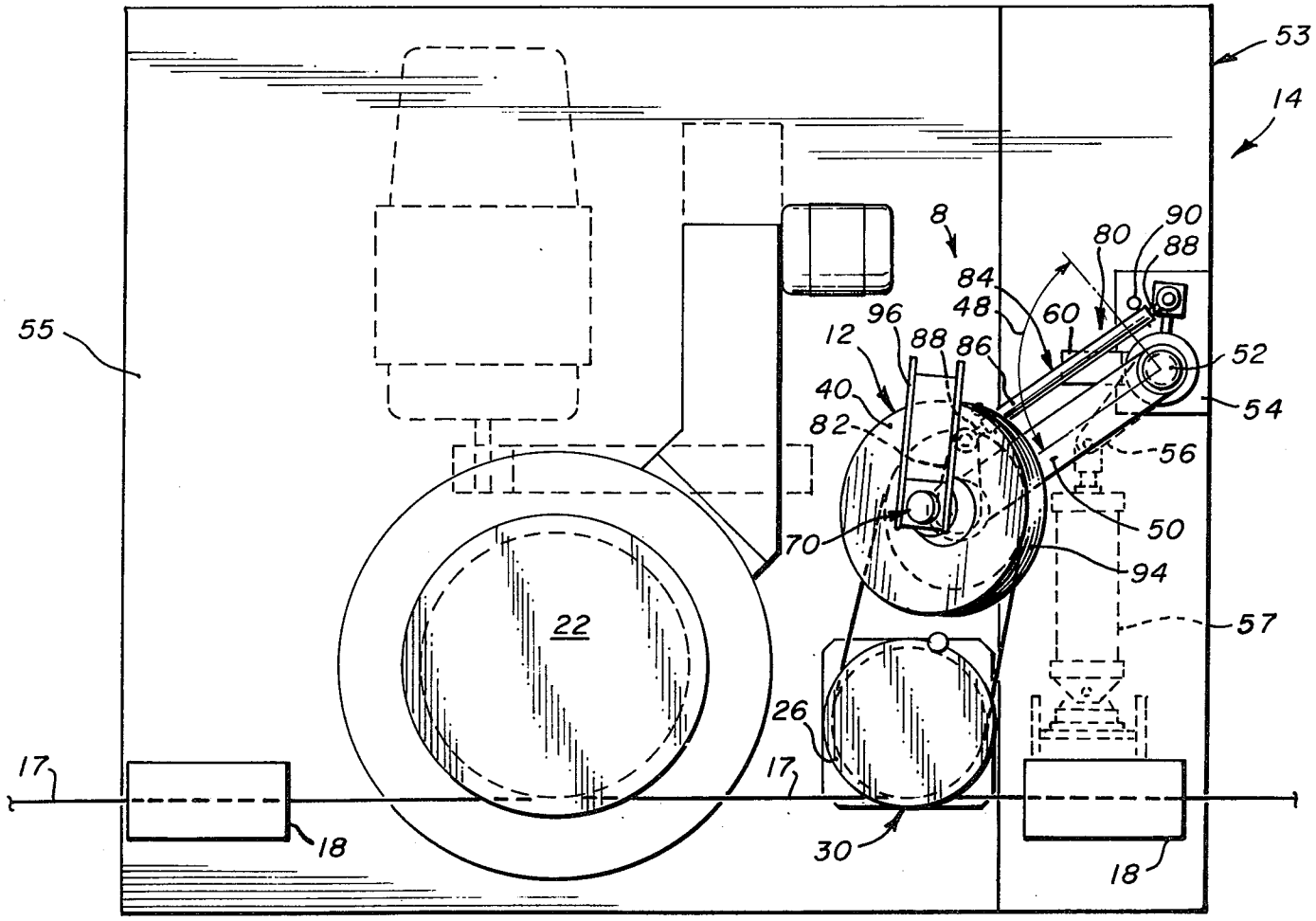
FIG. 2 is an enlarged, generally diagrammatic, partial top plan view, partly broken away, of a drawing stage of the wire drawing system, showing a dancer pulley mechanism thereof.

Referring now to the drawings in detail wherein like numerals represent like parts throughout the several figures, an embodiment 8 of a dancer pulley mechanism of the present invention is shown employed in a multiple stage wire drawing system 10 having seven successive drawing stages 14, 16, only partly shown in FIGS. 1 and 2. The drawing stages 14, 16 are mounted in horizontal alignment and so that wire stock 17 is fed directly from each drawing stage to the succeeding stage and through seven horizontally aligned die blocks 18 of the seven drawing stages. In a conventional manner, suitable means (not shown) is provided for feeding wire stock to the first stage die block 18, and a suitable spooler or other device (not shown) may be provided for receiving the drawn wire from an exit guide pulley 20 of the last stage 16. The first six stages 14 preferably are substantially identical for simplicity of construction, operation and maintenance, and the last stage 16 is suitably designed for feeding the drawn wire to a suitable spooler, etc. (not shown), or for coiling the wire at the last stage 16 using a suitable stripper block 21.

The first six stages 14 and last stage 16 have suitable draw blocks 22, 21 respectively which are preferably mounted in horizontal alignment and with their axes of rotation vertical and parallel. Also, the seven die blocks 18 preferably are mounted in horizontal alignment and with their aligned axes tangential to the draw blocks 22, 21 at the lower axial ends of the draw blocks and so that the wire stock 17 feeds directly from each die block 18 to the lower end of the succeeding draw block 22, 21. The die blocks 18 are pivotally mounted, and suitable air cylinders 23 are provided for pivoting the die blocks upwardly to assist in threading the wire stock from each die block 18 (with a suitable gripper jaw (not shown) connected to the upper end of the succeeding die block) to and around the succeeding draw block. The wire stock is coiled upwardly around each draw block 22, 21 to form a multiple turn helical coil extending axially upwardly from the lower end flange 25 of the draw block 22, 21 to an upper level, which, in the case of the first six drawing stages 14, is substantially in alignment with an upper guide pulley 26 of a succeeding rotary guide pulley assembly 30. Each wire turn about each draw block is forced axially upwardly on the draw block by the succeeding turn as it is fed onto the draw block during the wire drawing process and, for that reason, the generally cylindrical draw blocks 22, 21 are preferably slightly tapered upwardly from their lower flanges 25. The coil heighth on each guide block 22 (e.g., a 16 inch coil heighth) largely depends on the heighth of the upper guide pulley 26 associated therewith, and the number of coil turns on each draw block additionally depends on the wire diameter at that stage of the drawing process (and which, for example, decreases from approximately ½ inch at the first stage draw block 22 to approximately ¼ inch at the last stage draw block 21).

The provision of a plurality of coil turns on each draw block 22, 21 provides improved wire stock cooling before and after each drawing step and to thereby ensure that the tensile strength of the wire stock, as enhanced by its internal grain structure produced by the wire drawing process, is not inadvertently lost through undesirable annealing of the wire stock during the drawing process. Also, for that purpose, suitable draw block water cooling systems (not shown) and air cooling systems (not shown) are employed for cooling the wire stock coils on the draw blocks.

Each guide pulley assembly 30 has a lower guide pulley 32 aligned with the succeeding die block 18 for guiding the wire stock from each drawing stage 14 to the die block 18 of the succeeding drawing stage. The coaxial rotatable guide pulleys 26, 32 of each guide pulley assembly 30 have an axial spacing substantially equal to the heighth of the coil on the associated draw block 22. The guide pulley assemblies 30 of the first six stages 14 are mounted with their axes vertical and in longitudinal alignment and with their lower guide pulleys 32 in tangential alignment with the succeeding die blocks 18 respectively.

A dancer pulley mechanism 8 is provided at each of the first six drawing stages 14 for maintaining and/or adjusting the wire tension of the wire stock between stages and for feeding the wire stock downwardly from the upper level of the upper guide pulley 26 to the lower level of the lower guide pulley 32. For that purpose, the dancer pulley mechanism 8 employs a dancer pulley 40 having a diameter, inclination and position relative to the respective non-aligned guide pulleys 26, 32 so that the wire stock is fed along a generally helical path extending partly around the upper guide pulley 26, then to and partly around the dancer pulley 40, then to and partly around the lower guide pulley 32 and into alignment with the succeeding die block 18. For example, a dancer pulley 40 having a 19-inch nominal diameter and 30° inclination is employed with guide pulleys 26, 32 having a 16-inch axial spacing and a 17-inch nominal diameter.

The wire is fed downwardly generally helically from the upper guide pulley 26 to the dancer pulley 26 to the dancer pulley 40, generally helically downwardly approximately halfway around the dancer pulley 40 and then generally helically downwardly, preferably approximately at the same rate of descent as along the dancer pulley 40, from the dancer pulley 40 to the lower guide pulley 32. Also, the wire stock preferably feeds generally helically around the guide pulleys 26, 32 for which purpose the guide pulleys 26, 32 have a relatively wide cylindrical guide surface 42, and whereby relatively rigid wire stock is fed along a generally helical path at a rate of descent which aminimizes wire twisting and which therefore facilitates wire threading as well as wire feeding during the drawing process.

In accordance with h present invention, the operational plane of the inclined dancer pulley axis (i.e., a vertical plane parallel to the vertical axis of the guide pulley assembly 30) is controlled throughout the entire angle 48 of pivotal movement of the dancer pulley so that the wire stock feeds properly onto and off the dancer pulley 40 as it shifts or oscillates back and forth through its pivotal arc or stroke of operation during the drawing process.

Figure 3:
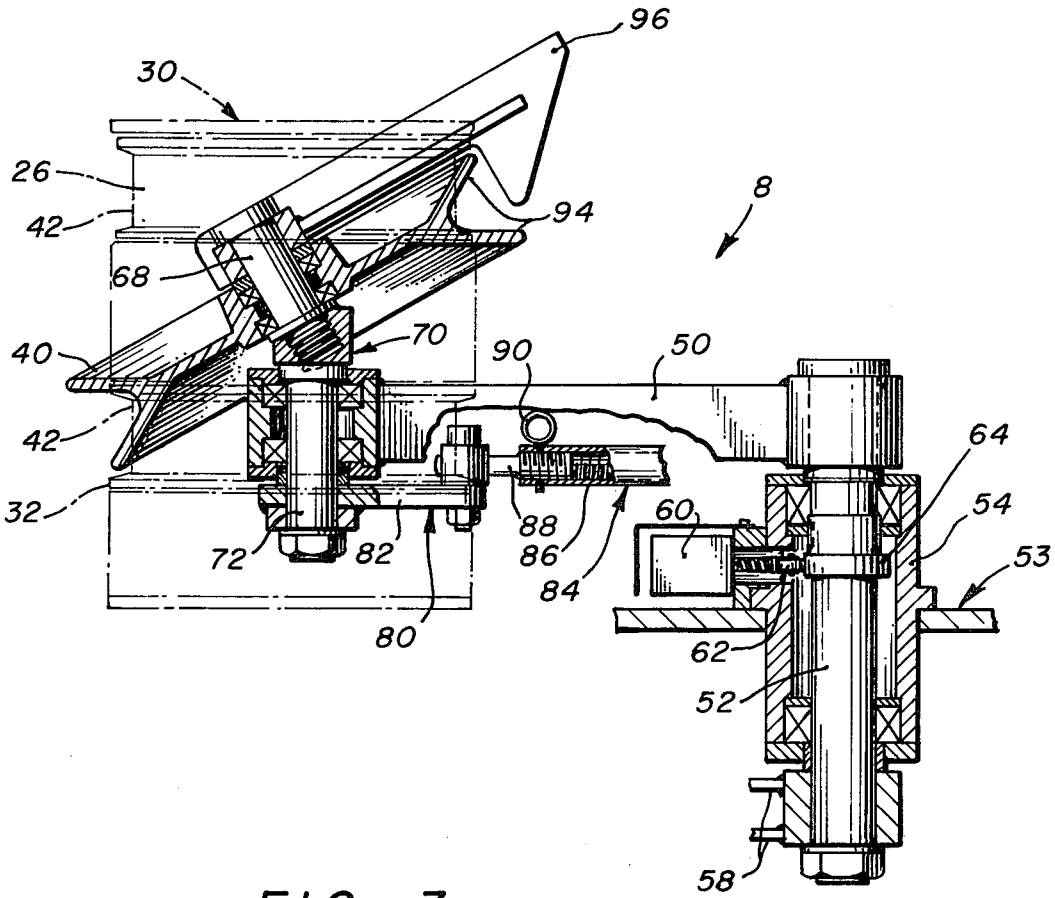
FIG. 3 is an enalrged elevation section view, partly broken away and partly in section, of the dancer pulley mechanism, additionally partly showing in broken lines upper and lower guide coaxial pulleys associated therewith.

Referring to FIG. 3, the dancer pulley 40 is rotatably supported on the outer end of a main pivot arm or lever 50 having an inner pivot shaft 52 fixed to the support arm 50 and rotatably mounted on a frame 54 of a dancer pulley module 53 of the drawing system. The dancer pulley module 53 is separately constructed and then sandwiched between alternating draw block modules 55, 56 of the system. The support arm 50 is free to pivot through an arc of for example 85° for shifting the dancer pulley 40 relative to the guide pulley assembly 30. Also, the support arm 50 is preferably short in order to reduce the required torsional force applied to the arm for tensioning the wire stock and to reduce the required structural strength of the arm 50 and its support shaft 52 and to reduce the size of the dancer pulley module 53. A suitable air cylinder 57 is connected to the support arm 50 through a lever 58 fixed to the lower end of the lever support shaft 52 to apply a predetermined outward torsional force for maintaining and/or adjusting the wire tension during the wire drawing process. Also, the air cylinder 57 is preferably connected to be operated for pivoting the support arm 50 inwardly to adjacent the guide pulley assembly 30 to facilitate initially threading the wire stock around the dancer pulley 40. The air cylinder 57 may also be used to establish the limits of pivotal movement of the dancer pulley support arm 50.

A sensor 60 having a spring biased roller 62 engaging a suitable cam 64 on the pivot shaft 52 is provided for sensing the pivotal position of the dancer pulley support arm 50. The sensor 60 is connected to a suitable speed control system (not shown) for adjusting the speed of the adjacent upstream draw block and for thereby adjusting the dancer pulley position, preferably so that the dancer pulley normally moves back and forth within about a 25° arc of operation at the center of its full 85° available range.

The dancer pulley 40 is rotatably mounted on an inclined shaft 68 of a shaft or rotor assembly 70 having a lower depending shaft 72 rotatably mounted within the outer end of the main support arm 50. The axis of the lower shaft 72 is parallel to the pivotal axis of the support arm 50 and therefore also to the axis of rotation of the coaxial guide pulleys 26, 32. The inclination of the upper shaft 68 is established, at 30° to the axis of the lower support shaft 72 in the exemplary embodiment shown and described, and so that the plane of the dancer pulley 40 is inclined 30° to the spaced parallel planes of the coaxial guide pulleys 26, 32 and so that the wire stock feeds generally helically between the guide pulleys 26, 32 and dancer pulley 40 as described.

A toggle type linkage 80 comprising a first lever arm 82 fixed to the lower end of the support shaft 72 and a second control arm 84 pivotally connected to the arm 82 and to the frame 54 of the dancer pulley module 53, is provided for rotating the dancer pulley support shaft 72 relative to the dancer pulley support arm 50 for automatically controlling the angular position of the vertical plane of the dancer pulley axis relative to the axis of the guide pulleys 26, 32 as the arm 50 pivots through its full operational angle of movement. In the shown embodiment, the links 82, 84 of the toggle linkage 80 are mounted to form with the support arm 50 and a fixed imaginary arm provided by the module frame 54, a parallelogram or pantograph type linkage. Accordingly, as the dancer pulley support shaft assembly 70 is fixed to the intermediate link 82 (and therefore can be considered mounted on the link 82), the angle of the vertical operational plane of the axis of the dancer pulley 40 remains the same in all pivotal positions of the dancer pulley support arm 50. Consequently, the angular relationship of the dancer pulley 40 to the upper and lower guide pulleys 26, 32 is established to remain approximately at the optimum relationship throughout the entire arc of travel of the dancer pulley and whereby, as the dancer pulley shifts back and forth, the wire stock will continue to feed freely from the upper guide pulley 26 to and partly around the dancer pulley 40 and then to the partly around the lower guide pulley 32 to the succeeding die block 18. As a result, the dancer pulley support arm 50 can be made relatively short without substantially adversely affecting the desired optimum angular relationship of the dancer and guide pulleys.

The control arm 84 comprises an intermediate torque tube 86 which is preferably connected at its opposite ends with oppositely threaded connections 88 and removable locking pins 90 so that the torque tube 86 will function like a turnbuckle and the effective length of the control arm 84 can be adjusted by removing the locking pins 90 and rotating the torque tube 86. The angular relationship of the dancer pulley 40 to the guide pulleys 26, 32 can thereby be adjusted as may be desired. Also, it is contemplated that the outer fixed end of the control arm 84 could be pivotally connected to the dancer pulley module frame 54 at a different point to vary the angular orientation of the dancer pulley as may be desired in a different type of wire drawing system. Preferably, however, in the shown wire drawing system, the angular relationship of the dancer pulley 40 to the coaxial guide pulleys 26, 32 is such that the vertical operational plane of the dancer pulley axis is perpendicular to or at least approximately perpendicular to a vertical plane extending through the vertical axis of the guide pulleys 26, 32 and through the center of the dancer pulley 40. That optimum orientation can be closely approximated with the control mechanism, and variations thereof, which have been described and whereby the dancer pulley support arm 50 can be made very short without affecting the operation of the dancer pulley throughout its entire arc of pivotal movement.

Referring to FIG. 3, the relationship of the guide pulleys 26, 32 (shown in part in broken lines) to the dancer pulley 40 is shown to help envision how the wire stock feeds smoothly from the upper guide pulley 26 to the dancer pulley 40 and from the dancer pulley 40 to the lower guide pulley 32. As shown, the dancer pulley 40 is preferably formed with inclined side flanges 94, having a 30° inclination in the shown example and thereby forming a 60° groove therebetween. As seen in FIG. 3, the wire stock feeds from the upper guide pulley 26 downwardly to engage the dancer pulley approximately at a point where the lower flange 94 extends horizontally outwardly and whereby the line stock feeds freely into the dancer pulley groove formed between the flanges 94. Similarly, the line stock is fed freely outwardly and downwardly from the dancer pulley approximately at a point where the upper flange 94 extends horizontally outwardly. Accordingly, the wire stock feeds relatively easily into the out of the dancer pulley groove during the initial threading operation and during the subsequent drawing process. Also, a generally L-shaped wire retainer 96 is mounted on the upper end of the inclined shaft 68 to assist in retaining the wire stock within the dancer pulley groove during the threading operation.

As will be apparent to persons skilled in the art, various modifications, adaptations and variations of the foregoing specific disclosure can be made without departing from the teachings of the present invention.

I claim:

1. In a multiple stage wire drawing system having a plurality of successive drawing stages, each having a die block and a succeeding rotatable draw block adapted for drawing wire stock through the die block and for receiving a generally helical coil of wire stock wound thereon, the multiple stage wire drawing system further having at least one guide and dancer pulley assembly, mounted operationally between a die block of a succeeding stage and the preceding draw block, and comprising a pair of axially spaced rotatable guide pulleys including a first guide pulley aligned for receiving wire stock from a coil on the preceding draw block and a second guide pulley aligned for feeding stock to the succeeding stage die block, a rotatable dancer pulley, and a dancer pulley control mechanism for shifting the dancer pulley back and forth, with its axis of rotation inclined to the axis of at least one of the guide pulleys for feeding wire stock from the first guide pulley to and partly around the inclined dancer pulley and then to and partly around the second pulley to the succeeding stage die block, for controlling the tension of the wire stock, the improvement wherein the dancer pulley control mechanism comprises a dancer pulley pivot arm pivotal back and forth for shifting the dancer pulley back and forth relative to the guide pulleys, a rotary support rotatably mounted on the pivot arm about a first axis generally parallel to and spaced from the pivot axis of the pivot arm and rotatably supporting the dancer pulley for rotation about a second axis inclined to said first axis, and angle control means connected to the rotary support and responsive to pivotal movement of the dancer pulley pivot arm for automatically rotating the rotary support relative to the pivot arm, in conjunction with the pivotal movement of the pivot arm, for automatically controlling the relationship of the axis of rotation of the dancer pulley to the guide pulleys.

2. A multiple stage wire drawing system according to claim 1 wherein the angle control means comprises connecting means connected to the rotary support and to a fixed axis for automatically rotating the rotary support relative to the pivot arm, in conjunction with the pivotal movement of the pivot arm, for automatically controlling the angular relationship of the rotary support to the fixed axis and thereby the relationship of the axis of rotation of the dancer pulley to the guide pulleys.

3. A multiple stage wire drawing system according to claim 2 wherein the first and second guide pulleys are coaxial and axially spaced, wherein the pivot axis of the pivot arm is parallel to the axis of the coaxial guide pulleys, and wherein the said fixed axis is parallel to the axis of the pivot axis and spaced therefrom.

4. In a dancer pulley mechanism having a rotatable dancer pulley for receiving line fed along a path to and from the dancer pulley, a dancer pulley pivot arm for pivoting the dancer pulley back and forth for varying the length of the line in the path to and from the dancer pulley, and dancer pulley support means for supporting the dancer pulley on the pivot arm with its axis of rotation inclined to the pivot axis of the pivot arm, the improvement wherein the dancer pulley support means comprises a rotary support rotatably mounted on the pivot arm about a first axis generally parallel to and spaced from the pivot axis of the pivot arm and supporting the dancer pulley for rotation about a second axis inclined to said first axis, and wherein the dancer pulley mechanism further comprises angle control means connected to the rotary support and responsive to pivotal movement of the dancer pulley pivot arm for automatically rotating the rotary support relative to the pivot arm, in conjunction with pivotal movement of the pivot arm, for automatically controlling the relationship of the inclined dancer pulley axis to the path of line feed to and from the dancer pulley.

5. In a dancer pulley mechanism according to claim 4 wherein the angle control means comprises connecting means connected to the rotary support and to a fixed axis for automatically rotating the rotary support relative to the pivot arm, in conjunction with pivotal movement of the pivot arm, for automatically controlling the angular relationship of the rotary support to the fixed axis and thereby the relationship of the inclined dancer pulley axis to the path of line feed to and from the dancer pulley.

6. In a multiple stage wire drawing system having a plurality of successive drawing stages, each having a die block and a succeeding rotatable draw block adapted for drawing wire stock through the die block and for receiving a generally helical coil of wire stock wound thereon, the multiple stage wire drawing system further having at least one guide and dancer pulley assembly, mounted operationally between a die block of a succeeding stage and the preceding draw block, and comprising a pair of axially spaced rotatable guide pulleys including a first guide pulley aligned for receiving wire stock from a coil on the preceding draw block and a second guide pulley aligned for feeding stock to the succeeding stage die block, a rotatable dancer pulley, and dancer pulley control mechanism for shifting the dancer pulley back and forth, with its axis of rotation inclined to the axis of at least one of the guide pulleys for feeding wire stock from the first guide pulley to and partly around the inclined dancer pulley and then to and partly around the second pulley to the succeeding stage die block, for controlling the tension of the wire stock, the improvement wherein the dancer pulley control mechanism comprises a dancer pulley pivot arm pivotal back and forth for shifting the dancer pulley back and forth relative to the guide pulleys, a rotary support rotatably mounted on the pivot arm about a first axis generally parallel to and spaced from the pivot axis of the pivot arm and rotatably supporting the dancer pulley for rotation about a second axis inclined to said first axis, and angle control means connected to the rotary support for rotating the rotary support relative to the pivot arm, in conjunction with the pivotal movement of the pivot arm, for controlling the relationship of the dancer pulley to the guide pulleys, the angle control means comprising a linkage connected to a fixed axis and to the rotary support and forming with the pivot arm a pantograph type connection for rotating the rotary support relative to the pivot arm.

7. In a multiple stage wire drawing system having a plurality of successive drawing stages, each having a die block and a succeeding rotatable draw block adapted for drawing wire stock through the die block and for receiving a generally helical coil of wire stock wound thereon, the multiple stage wire drawing system further having at least one guide and dancer pulley assembly, mounted operationally between a die block of a succeeding stage and the preceding draw block, and comprising a pair of axially spaced rotatable guide pulleys including a first guide pulley aligned for receiving wire stock from a coil on the preceding draw block and a second guide pulley aligned for feeding stock to the succeeding stage die block, a rotatable dancer pulley, and a dancer pulley control mechanism for shifting the dancer pulley back and forth, with its axis of rotation inclined to the axis of at least one of the guide pulleys for feeding wire stock from the first guide pulley to and partly around the inclined dancer pulley and then to and partly around the second pulley to the succeeding stage die block, for controlling the tension of the wire stock, the improvement wherein the dancer pulley control mechanism comprises a dancer pulley pivot arm pivotal back and forth for shifting the dancer pulley back and forth relative to the guide pulleys, a rotary support rotatably mounted on the pivot arm about a first axis generally parallel to and spaced from the pivot axis of the pivot arm and rotatably supporting the dancer pulley for rotation about a second axis inclined to said first axis, and angle control means connected to the rotary support for rotating the rotary support relative to the pivot arm, in conjunction with the pivotal movement of the pivot arm, for controlling the relationship of the dancer pulley to the guide pulleys, the rotary support comprising a first shaft mounted on the pivot arm for rotation about a first axis parallel to the pivot axis of the pivot arm and a second shaft having an axis inclined to said first axis and rotatably supporting the dancer pulley.

8. In a dancer pulley mechanism having a rotatable dancer pulley for receiving line fed along a path to and from the dancer pulley, a dancer pulley pivot arm for pivoting the dancer pulley back and forth for varying the length of the line in the path to and from the dancer pulley, and dancer pulley suppoort means for supporting the dancer pulley on the pivot arm with its axis of rotation inclined to the pivot axis of the pivot arm, the improvement wherein the dancer pulley support means comprises a rotary support rotatably mounted on the pivot arm about a first axis generally parallel to and spaced from the pivot axis of the pivot arm and supporting the dancer pulley for rotation about a second axis inclined to said first axis, and wherein the dancer pulley mechanism further comprises angle control means connected to the rotary support for rotating the rotary support relative to the pivot arm, in conjunction with pivotal movement of the pivot arm, for controlling the relationship of the inclined dancer pulley axis to the path of line feed to and from the dancer pulley, the angle control means comprising a toggle linkage connected to a fixed axis and to the rotary support and forming with the pivot arm a pantograph type connection for rotating the rotary support relative to the pivot arm.

9. In a dancer pulley mechanism having a rotatable dancer pulley for receiving line fed along a path to and from the dancer pulley, a dancer pulley pivot arm for pivoting the dancer pulley back and forth for varying the length of the line in the path to and from the dancer pulley, and dancer pulley support means for supporting the dancer pulley on the pivot arm with its axis of rotation inclined to the pivot axis of the pivot arm, and improvement wherein the dancer pulley support means comprises a rotary support rotatably mounted on the pivot arm about a first axis generally parallel to and spaced from the pivot axis of the pivot arm and supporting the dancer pulley for rotation about a second axis inclined to said first axis, and wherein the dancer pulley mechanism further comprises angle control means connected to the rotary support for rotating the rotary support relative to the pivot arm, in conjunction with pivotal movement of the pivot arm for controlling the relationship of the inclined dancer pulley axis to the path of line feed to and from the dancer pulley, the rotary support comprising a first shaft mounted on the pivot arm for rotation about a first axis parallel to the pivot axis of the pivot arm and a second shaft having a second axis inclined to said first axis and rotatably supporting the dancer pulley.

* * * * *